US006125652A

United States Patent [19]

Vogel et al.

[11] Patent Number: 6,125,652

[45] Date of Patent: Oct. 3, 2000

[54] APPARATUS FOR MINIMIZING REFRIGERANT USAGE

[75] Inventors: Kenneth E. Vogel; Christopher D. Hensch, both of Yuma, Ariz.

[73] Assignee: Ardco, Inc., Chicago, Ill.

[21] Appl. No.: 09/384,964

[22] Filed: Aug. 27, 1999

[51] Int. Cl.[7] ..... F25B 39/04

[52] U.S. Cl. ..... 62/509

[58] Field of Search ..... 62/509, 474; 165/109.1, 165/110

[56] References Cited

U.S. PATENT DOCUMENTS

| | | | |
|---|---|---|---|
| 4,920,766 | 5/1990 | Yamamoto et al. | 62/474 |
| 5,509,466 | 4/1996 | McQuade et al. . | |
| 5,605,054 | 2/1997 | Chen . | |
| 5,724,830 | 3/1998 | Otis et al. . | |
| 5,790,619 | 8/1998 | Peck . | |
| 5,799,339 | 9/1998 | Perry et al. . | |
| 5,857,347 | 1/1999 | Haugen et al. . | |
| 5,876,598 | 3/1999 | Baxter . | |
| 5,934,102 | 8/1999 | DeKeuster et al. | 62/509 |

*Primary Examiner*—William Doerrler
*Assistant Examiner*—Marc Norman
*Attorney, Agent, or Firm*—Knobbe, Martens, Olson & Bear, LLP

[57] ABSTRACT

A refrigeration system is provided with a receiver and a plate attached to the mouth of the outlet tube of the receiver to prevent the formation of a liquid refrigerant vortex. The mouth of the receiver outlet tube has an enlarged cross-sectional area to decrease the velocity of the liquid entering the tube. A deflector for vertical receiver applications interrupts refrigerant downward flow from the receiver inlet to prevent bubble formation in the liquid.

16 Claims, 7 Drawing Sheets

APPARATUS FOR MINIMIZING REFRIGERANT USAGE

BACKGROUND OF THE INVENTION

1. Field of the Invention

This invention relates to refrigeration apparatus and more particularly to a receiver specially adapted to minimize the refrigerant needed in a refrigeration system.

2. Description of the Related Art

Refrigeration systems typically have a receiver down-stream from the condenser as a separate component. A receiver provides storage of a volume of refrigerant sufficient to accommodate for variations in system operating conditions and loss of refrigerant. When the refrigeration system is not in operation, most of the refrigerant is contained in the receiver. Ideally, the system will have only the amount of refrigerant in it needed to accommodate its various operating conditions. This ideal amount can be calculated, and installers of the refrigeration system may be advised to charge the system with only that quantity of refrigerant plus the amount needed to ensure that only liquid refrigerant flows out of the receiver. However, a typical receiver has capacity for storing considerably more refrigerant than what is needed and the procedure followed by installers in charging a system results in more refrigerant being used than would seem to be necessary.

Many systems employ a device called a sight glass downstream from the receiver which provides a view to the refrigerant flowing from the receiver. When charging a system there is initially a mixture of liquid and vapor refrigerant flowing out of the receiver. Installers observe the mixture through the sight glass and are instructed to continue adding refrigerant until bubbles, which are indicative of vapor in the system, are no longer visible in the sight glass, because liquid covers the inlet to an outlet tube in the receiver. After bubbles are no longer observed, some installers will add more just to be certain that there is enough. This results in undesirable over-charging of the receiver. The present inventor has determined during the development of this invention that overcharging, which occurs in prior art systems, ranges from 25 to 35 percent of the volume of the receiver—more than double what was previously thought. Over-charging, of course, in effect, wastes refrigerant and adds to the cost of the system. With inexpensive refrigerants, this may not have been a very significant factor; however, because of environmental concerns, it is now required that different refrigerants are employed, and they are more expensive.

Construction of the receiver is one known factor which affects the quantity of refrigerant required to stop vapor bubbles from being observed in the sight glass. Basically the receiver comprises a container in which liquid refrigerant collects, with vapor refrigerant above the liquid. An outlet tube for withdrawing liquid from the receiver typically extends through an upper wall of the receiver and has an open lower end positioned near the bottom of the container. In order to withdraw only liquid from the receiver (a circumstance in which the receiver is said to have a liquid seal), it is necessary that the open lower end always be covered by liquid. But, as mentioned above installers filling systems which have a sight glass report that significantly more refrigerant is needed to create a liquid seal than simply that required to cover the mouth of the tube inlet. That additional quantity of refrigerant is essentially an unproductive percentage of the refrigerant from the cooling standpoint.

In some industrial applications, unproductive use of refrigerant has been reduced by adding a secondary reservoir at the bottom of the receiver into which the outlet tube extends. In this way, deeper insertion of the receiver outlet tube is possible so that less refrigerant is needed to provide the liquid seal.

Other commercial applications reduce refrigerant levels by tilting the receiver container so that the end of the container into which the outlet tube extends is the lower end, thus causing the refrigerant level at that end to increase. This means that for the same or less refrigerant, vapor-free flow down-stream from the receiver can be assured.

While both of these prior art approaches result in less refrigerant, they have their draw-backs. A secondary reservoir is inconvenient because it requires a special housing for ground clearance of the secondary reservoir. The method of tilting the receiver container is useful but fails to reduce the level of refrigerant needed for liquid seal close enough to the level needed for proper operation of the system. Thus, a need exists for an improved receiver design that will further minimize the refrigerant required.

SUMMARY OF THE INVENTION

The invention applies applicant's discovery that the excess refrigerant in a receiver is made necessary by a vortex which forms in the liquid refrigerant and extends from the liquid surface down toward and into the mouth of the outlet tube. The vortex provides a way for refrigerant vapor to travel from above the liquid refrigerant into the outlet tube and hence down-stream from the receiver. To discover the extent of the vortex, the a conventional receiver was modified by replacing one end with a transparent material. The receiver, so modified, was placed in an otherwise conventional refrigeration system and the refrigerant flow observed. This observation confirmed that the principle reason for excess refrigerant was the presence and surprising depth of this vortex. Given its strength and size it became apparent why installers using sight glasses had to over-charge a system in order to achieve the liquid seal. Discovering this phenomenon led to the present invention.

Briefly stated, the present invention provides a means to prevent a vortex from forming in a receiver of a refrigeration system, thus reducing the refrigerant required to achieve liquid seal of the inlet to a refrigerant outlet tube. In one embodiment the receiver includes a device for disturbing the vortex which comprises a generally flat element extending away from the receiver outlet tube. The element prevents flow directly into the tube, and instead directs the flow beneath the edges of the element. In a preferred embodiment the device is a rectangular plate having feet at either end. The feet provide a gap between the tank bottom and the bottom of the device. This gap allows refrigerant to flow to the tube inlet, while the feet provide a firm stop for positioning the outlet tube in the receiver.

To further assist vapor free flow, the lower end of the outlet tube is enlarged so that the velocity of the liquid is reduced at the inlet to the tube. This results in less force for pulling vapor in.

Thus, in accordance with the method of the invention, means are provided to prevent the formation of a vortex in the liquid refrigerant that in a receiver of a refrigerant system would otherwise cause vapor to flow into an outlet tube.

For receivers which have the refrigerant inlet near the outlet tube, such as in vertically oriented receivers, a splash deflector may be provided to deflect refrigerant entering the receiver to prevent vapor bubble formation in the liquid near the mouth of the outlet tube. The deflector may take the form of a flat plate that can be mounted to the outer tube or mounted like a shelf on a wall of the receiver. Alternatively the inlet tube can deflect the liquid flow against the wall of the receiver to prevent splashing.

DETAILED DESCRIPTION OF THE PREFERRED EMBODIMENT

Figure 1:
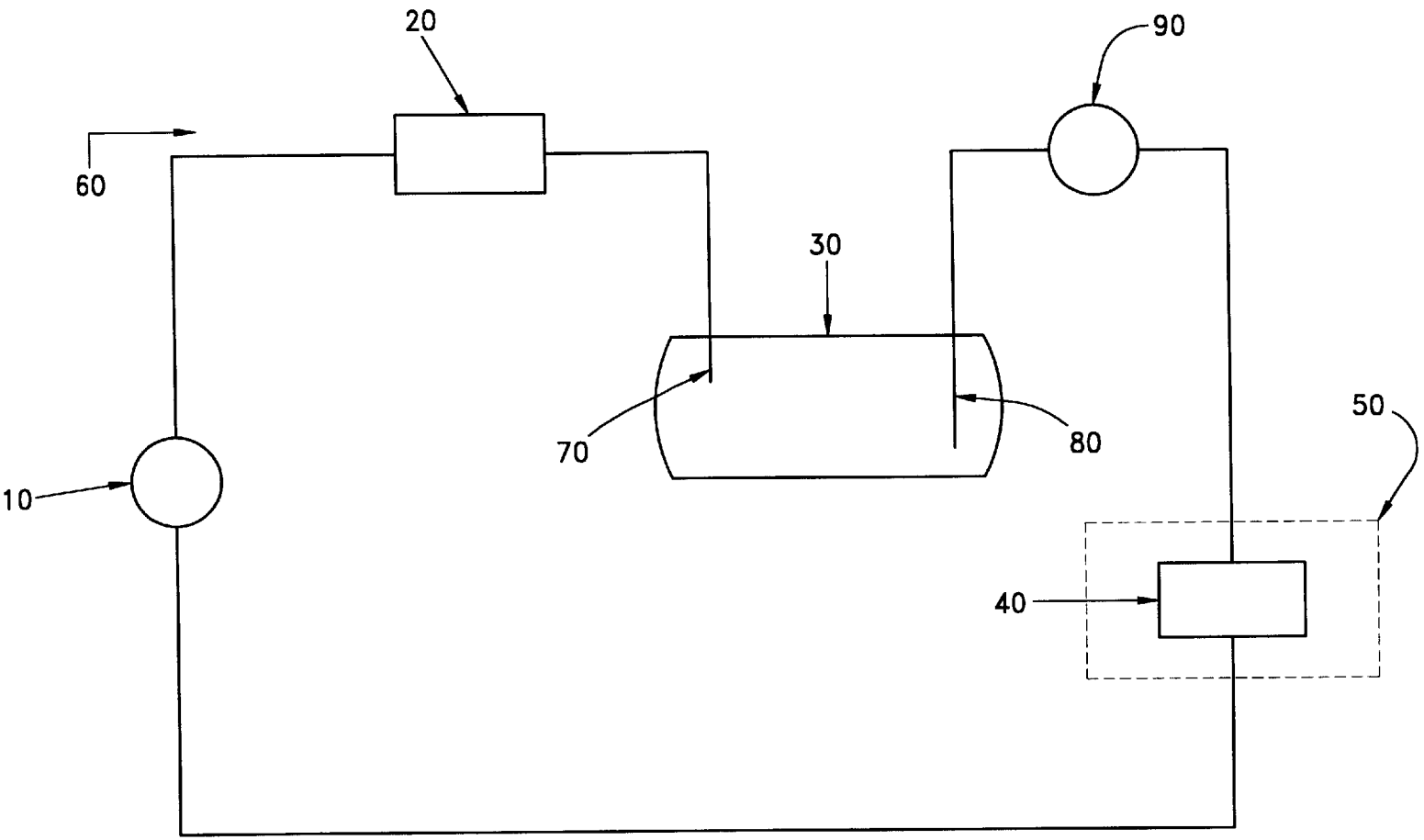
FIG. 1 (PRIOR ART)
FIG. 1 schematically illustrates a refrigeration system, including a receiver.

The invention claimed in this patent involves one component in a refrigeration system illustrated schematically in FIG. 1. This system comprises a compressor 10, a condenser 20, a receiver 30 having inlet tube 70 and outlet tube 80, an evaporator 40 and a sight glass 90. The evaporator 40 is placed in a region 50 and removes heat from that region. During normal operation, refrigerant flows through the system cyclically in the direction shown by arrow 60.

For the pressure in the system at the evaporator, the refrigerant boiling point is below the desired temperature of region 50. As the liquid refrigerant enters the evaporator 40 which is positioned in the region 50 it begins to absorb heat from the region. The heat absorbed by the refrigerant transforms the liquid refrigerant into vapor; that heat is then carried out of the region 50 with the refrigerant vapor. As a result, the temperature in region 50 is reduced. The rest of the system is designed to convert the refrigerant vapor back into liquid form. The vapor from the evaporator passes into the compressor 10 where its pressure is raised. Under pressure, the boiling point of refrigerant is higher than the temperature in the condenser and as a result the refrigerant condenses. Liquid and vapor, as a mixture, flow from the condenser through inlet tube 70 and into the receiver 30 which acts both as a collector for refrigerant and as a seal to assure vapor free refrigerant is delivered to the evaporator for the cycle to begin again. Outlet tube 80 is designed and positioned in receiver 30 to create a liquid seal, that is to assure that only liquid form refrigerant exits the receiver and passes into the evaporator 40.

Figure 2B:
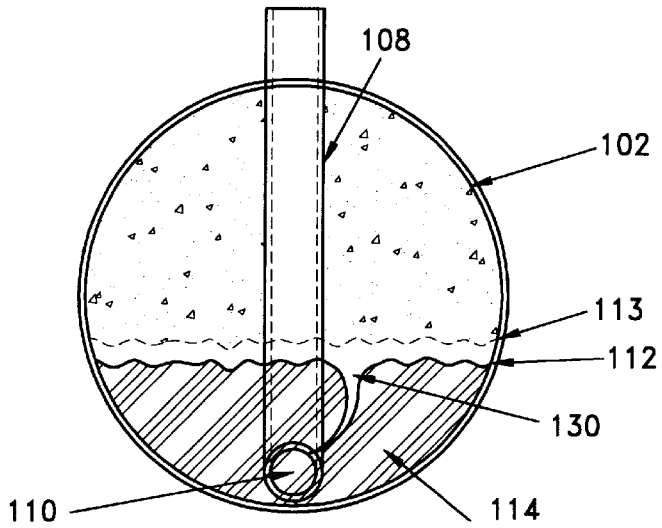
FIG. 2B (PRIOR ART)
FIG. 2B shows a cross-sectional view of FIG. 2A.
Figure 2A:
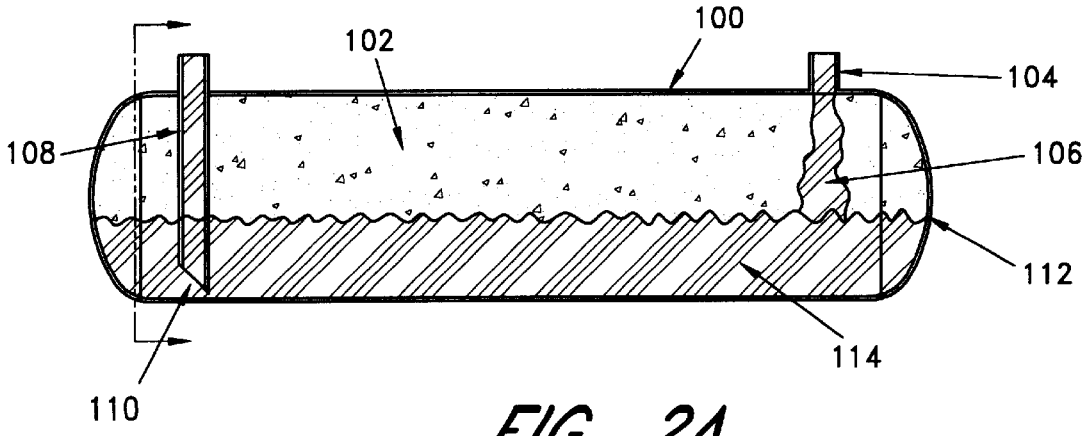
FIG. 2A (PRIOR ART)
FIG. 2A schematically illustrates a prior art commercial horizontal receiver.

The prior art commercial horizontal receiver 100 illustrated in FIG. 2A includes a container 102, an inlet tube 104 conducting into the container a liquid and vapor refrigerant mixture 106, and an outlet tube 108. The outlet tube for carrying liquid refrigerant is submerged up to level 112 of liquid refrigerant 114. The cross sectional view of FIG. 2B shows the mouth 110 of the outlet tube 108. A vortex 130 forms when the system rapidly pulls the liquid refrigerant 114 into the mouth of the outlet tube. Vapor can thus be drawn through the vortex into the tube.

As mentioned above, the receiver has both the function of collecting refrigerant that exits the condenser 20 and of assuring a liquid seal (that only liquid refrigerant passes from the receiver to the evaporator by means of the receiver outlet tube). The first function is provided by the inlet tube 104 which is connected to the condenser 20 upstream from the receiver (see flow direction indicated by arrow 60 in FIG. 1). This inlet delivers the vapor and liquid mixture to the receiver container 102. The receiver container usually has a capacity much greater than the amount of refrigerant needed for various conditions of use. As more liquid refrigerant enters the receiver the level of the refrigerant rises to the point indicated by level 112. The outlet tube 108 pulls liquid refrigerant from the receiver 100 as needed in the system. Refrigerant delivered from the receiver to the rest of the system must be vapor free. The chief obstacle to achieving this liquid seal is the vortex 130. To overcome the tendency of the vortex to break the liquid seal, the level of refrigerant 112 is raised to level 113, as seen in FIG. 2B.

A similar receiver can also be made where the container is vertically positioned rather than horizontally positioned. Another embodiment known in the art is identical to that shown in 2A, but with the container 102 tilted such that the end with the outlet tube is lower than the opposite end. This causes the refrigerant level in the end with the outlet tube to be higher and thus improves the liquid seal.

Figure 3:
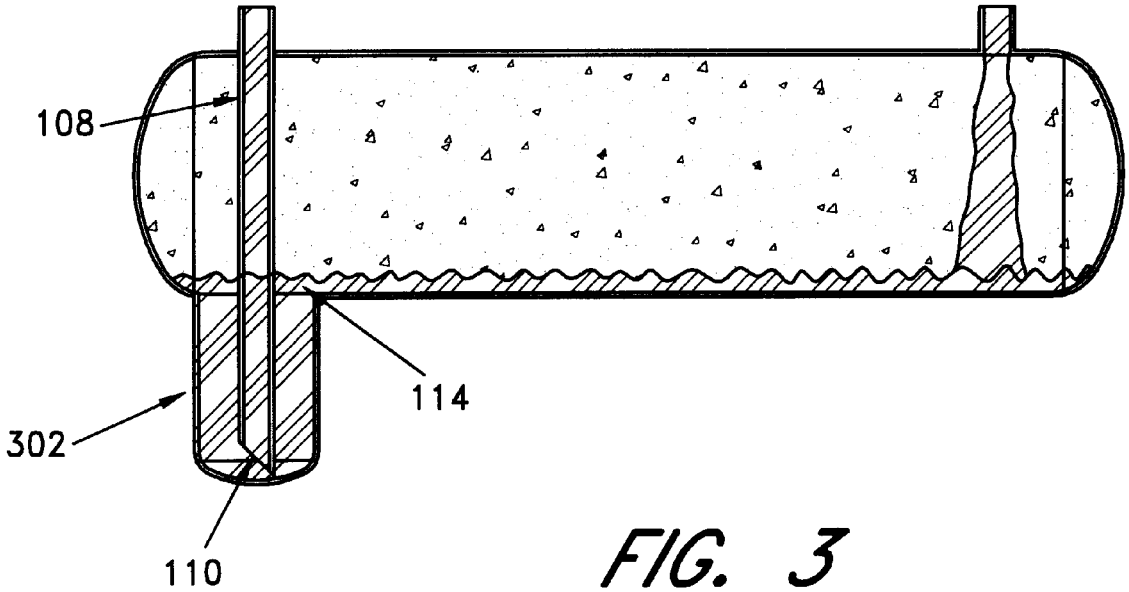
FIG. 3 (PRIOR ART)
FIG. 3 schematically illustrates a prior art industrial horizontal receiver.

Another prior art design to reduce the level of refrigerant needed to assure vapor free refrigerant entering the evaporator is illustrated by FIG. 3. The configuration and geometry of this design are very similar to that shown in FIG. 2A and 2B with the exception that this embodiment includes a secondary reservoir 302. This reservoir is positioned beneath the receiver outlet tube 108 which extends down into the secondary reservoir. This puts the mouth 110 of the outlet tube 108 at least as far from the surface of the liquid refrigerant 114 as in FIGS. 2A and 2B with the same or less refrigerant. The result is improved liquid seal at the mouth of the outlet tube. However, it is inconvenient or not possible to use this receiver configuration in many installations.

Figure 4B:
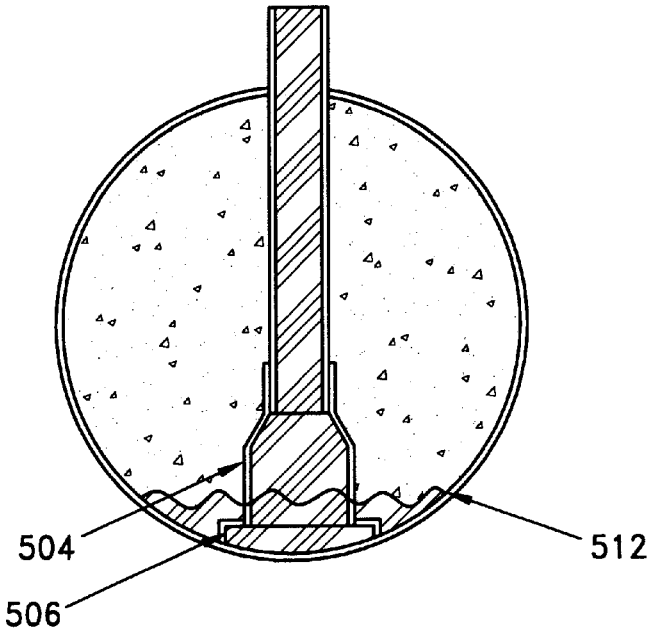
FIG. 4B shows a cross-sectional view of FIG. 4A. defined by section 4B—4B.
Figure 4A:
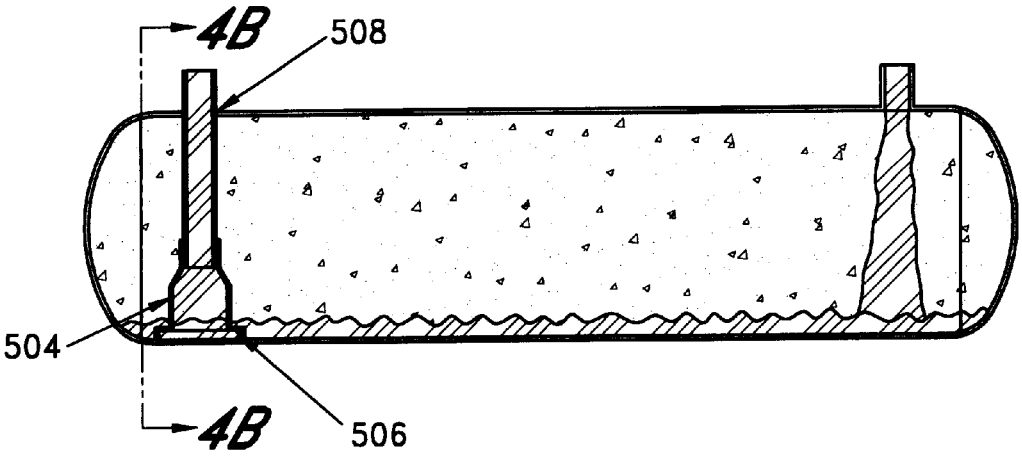
FIG. 4A schematically illustrates a receiver incorporating the invention.

In accordance with the invention, FIGS. 4A and 4B illustrate a receiver adding a structure for reducing refrigerant usage. This includes a vortex disturbing device 506, connected to the lower end of the outlet tube 508. Rather than increasing refrigerant to prevent a vortex from pulling vapor into the receiver outlet tube 508, the device 506 breaks-up or disturbs the vortex. Vortex disturbing device 506 interferes with the tendency of the liquid entering the outlet tube to form the vortex. As a result, vapor from the surface is not pulled down into the vicinity of the outlet tube opening. As a further help to reduce vortex formation, the liquid flow rate into the outlet tube is reduced. Reduction of flow-rate is accomplished by providing a section 504 which has a cross-sectional area on the lower end of the outlet tube which is larger than the upper portion of the tube. These two features are of course useful separately, but as taken together further buttress the liquid seal. As a result, the surface 512 of the liquid refrigerant can be much closer to the mouth of the tube than in the prior art of FIG. 1A. These techniques can reduce the refrigerant level by as much as 30 per cent compared to prior art horizontal receivers.

The receiver employing the apparatus for minimizing refrigerant can also be tilted, as described above, to gain the additional advantage of greater refrigerant depth in the receiver outlet tube locale.

Figure 5:
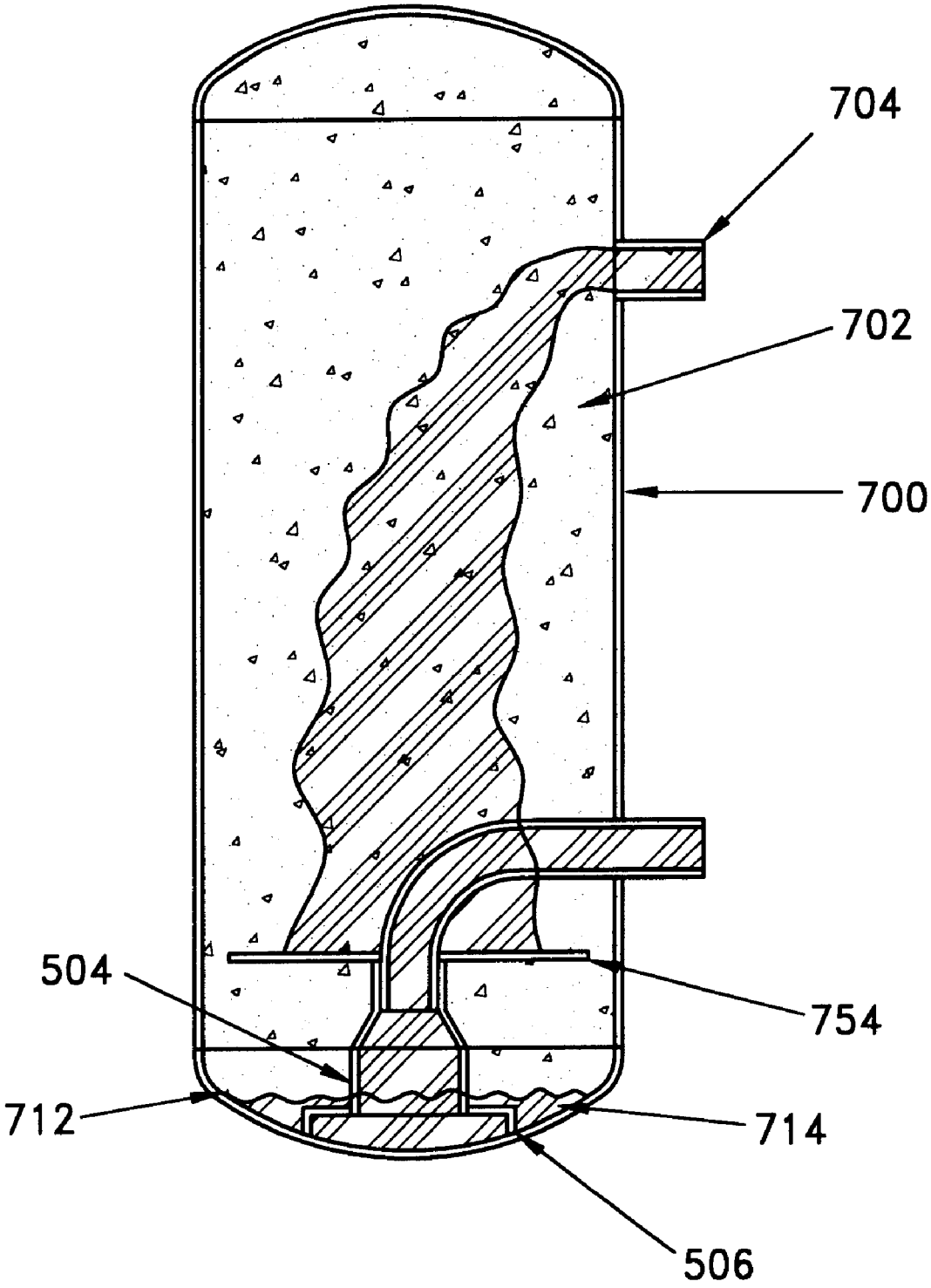
FIG. 5 schematically illustrates a vertical receiver incorporating the invention.

FIG. 5 illustrate the techniques for minimizing refrigerant usage in a vertical oriented receiver. The vertical receiver 700 illustrated in FIG. 5 includes a container 720, an inlet tube 704 conducting a liquid and vapor refrigerant mixture 706 into the container and an outlet tube 708 submerged in liquid refrigerant 714 to level 712. The liquid seal created by the apparatus for reducing refrigerant usage permits only liquid refrigerant to pass out from the receiver in the outlet tube. The same vortex disrupter as described above and as shown in FIG. 4B is useful in this vertical configuration.

In addition, a deflector 754 is included to deflect the downward flow of refrigerant entering the receiver. This deflection protects the liquid seal by preventing excessive splashing which can push bubbles of refrigerant vapor beneath the liquid refrigerant surface causing refrigerant vapor to enter the outlet tube. In other aspects, the device functions the same as described above and shown in FIGS. 4A and 4B. In the arrangement shown, the deflector is mounted on the outlet tube, but it can be supported on a receiver wall. The deflector is illustrated as a horizontal shelf but many other arrangements may be employed to prevent bubble formation in the liquid. Deflecting the flow against a receiver wall is a practical approach. The use of a deflector is primarily useful when the inlet is near the outlet tube as in a vertical receiver.

Figure 6:
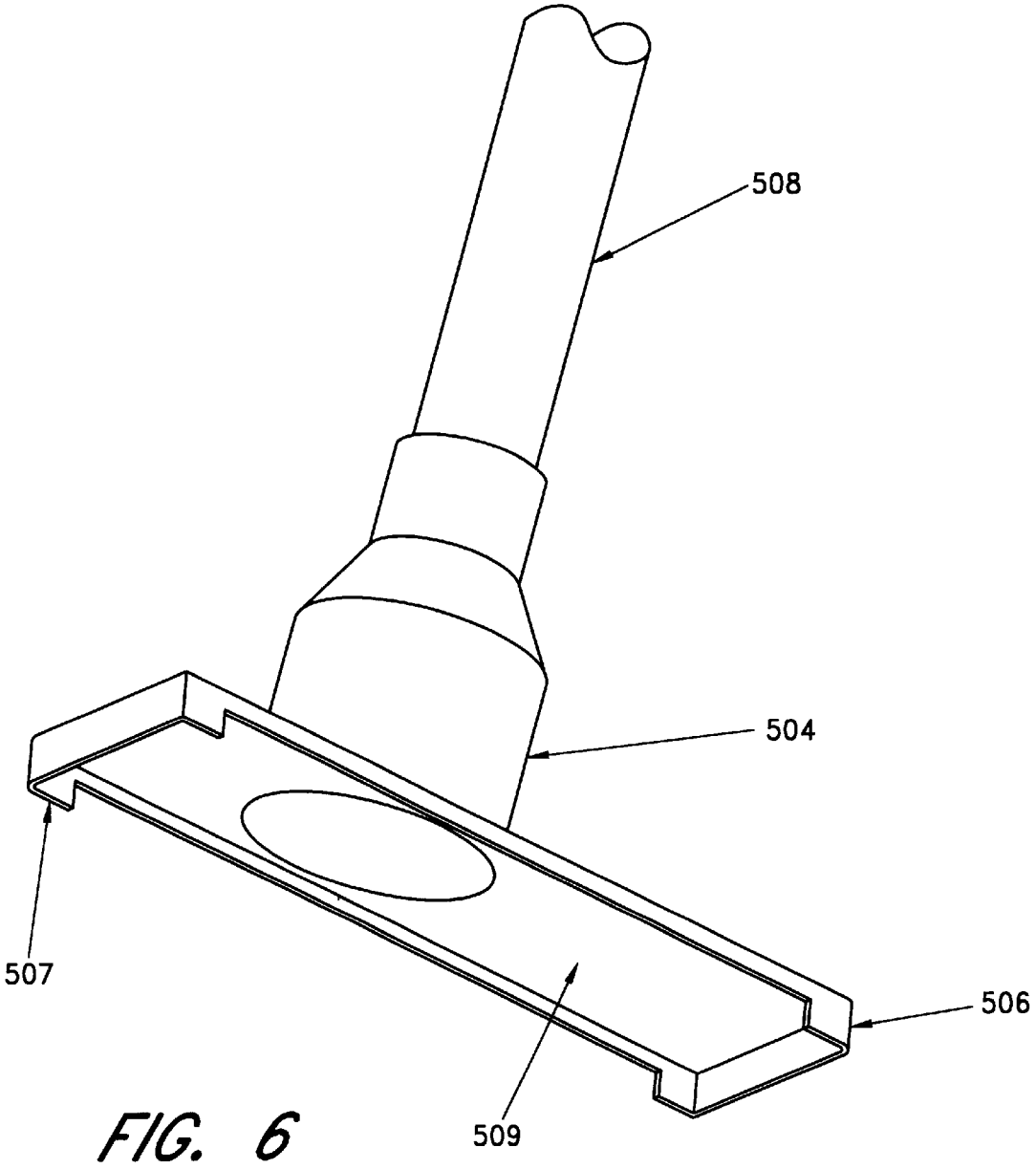
FIG. 6 shows a perspective view of the pick-up tube and the device for minimizing refrigerant usage.

FIG. 6 is an enlarged perspective view of one embodiment of the apparatus for minimizing refrigerant usage. In this embodiment the expansion section 504 increases the cross-sectional area of the outlet tube 508. This reduces the flow rate of refrigerant at the opening of the tube. The vortex disturbing device 506 is in the form of a horizontal, rectangular or circular plate 509 attached to the lower end of the expansion section 504. At either end of the plate 509 are feet 507 which create a space between the receiver container bottom and the plane of the outlet tube entrance. In addition these feet provide a hard stop against the receiver container bottom. Various feet arrangements may be employed. Additionally, while the thin, flat, perforate plate 506 is an effective and efficient configuration, various other arrangements can be employed so long as they prevent vortex formation, while yet permitting liquid flow into the month of the outlet tube. For the vertical receiver of FIG. 5, a circular plate is appropriate.

Figure 7:
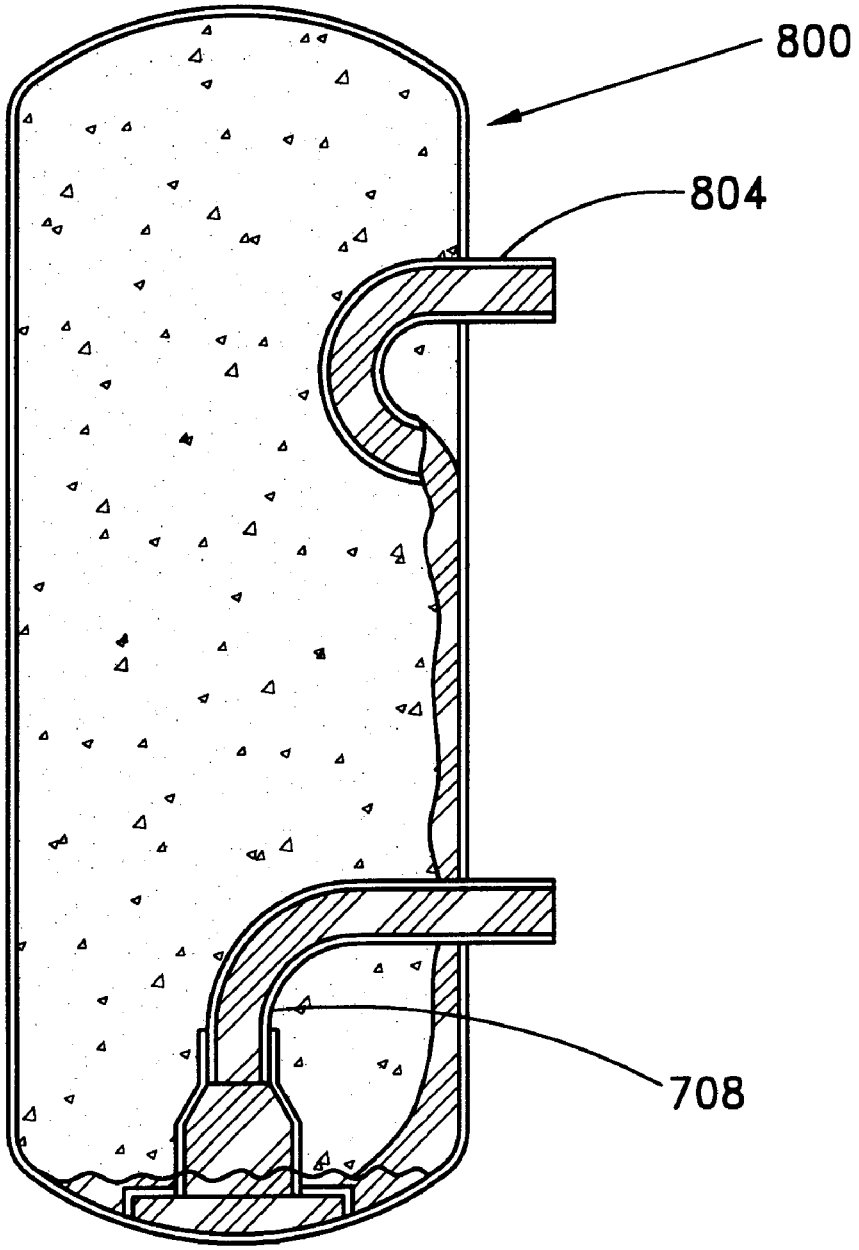
FIG.7 illustrates a vertical receiver having incoming liquid directed against the receiver wall.

FIG. 7 illustrates an alternate anti-splash arrangement for a vertical receiver 800 wherein an inlet tube 804 is curved at its outlet so that the incoming liquid is directed against the vertical wall of the receiver. The liquid thus flows down the wall without creating gas bubbles in the liquid around the mouth of the outlet tube 708.

What is claimed is:

1. A receiver to minimize the amount of refrigerant used in a refrigeration system, said receiver comprising:

a container having an inlet for receiving refrigerant which is usually partially in liquid form and partially in vapor form;

a liquid refrigerant outlet tube extending into the container with an inlet to the tube located adjacent a low point in the container to enable liquid refrigerant to be drawn out of the container; and a device positioned adjacent the tube inlet to prevent a vortex from being formed in the liquid refrigerant that could cause refrigerant vapor to be drawn into the tube inlet.

2. The receiver of claim 1, wherein said device comprises an opening for receiving said tube adjacent to the tube inlet and extends outwardly from the tube inlet to block a vortex from forming in that area, said device being configured with respect to a bottom wall of the container so that liquid refrigerant flows past one or more outer edges of the device and beneath said device before reaching the inlet to the tube.

3. The receiver of claim 2, wherein said device comprises a generally flat plate which extends radially out from the tube, and said plate has one or more portions which space the plate slightly from the lower surface of the container to define one or more passages through which liquid refrigerant can flow to the tube inlet.

4. The receiver of claim 3, wherein the inlet of said tube has an enlarged cross-section in relation to an upper portion of the tube to minimize the velocity of liquid refrigerant entering the tube.

5. The receiver of claim 1, including an element positioned in said container to deflect refrigerant flow from the container inlet in a manner to minimize the formation of vapor bubbles in the refrigerant liquid collecting in the container.

6. The receiver of claim 5, wherein said device element extends radially from the outlet tube a distance above the outlet tube inlet to deflect refrigerant entering the receiver.

7. A receiver to minimize the amount of refrigerant needed in a refrigeration system, said receiver comprising:

a container having an inlet for receiving refrigerant which is partially in liquid form and partially in vapor form;

a liquid refrigerant outlet tube extending into the container with an open lower end of the tube located adjacent a low point in the container to form an inlet to the tube through which liquid refrigerant may be drawn out of the container; and means adjacent the lower end of the tube to prevent a vortex from being formed in the liquid refrigerant as it is drawn into the tube.

8. The receiver of claim 7, wherein said container inlet is located above the normal level of liquid refrigerant in the container and the receiver includes means to prevent refrigerant falling from said container inlet from introducing refrigerant vapor bubbles into the liquid refrigerant in the lower portion of the container.

9. The receiver of claim 8, wherein said bubble preventing means comprises an element to deflect the flow of incoming refrigerant to prevent it from falling directly into the liquid refrigerant in the lower portion of the container.

10. The receiver of claim 7, wherein said means comprises a plate adjacent the lower end of the tube and extending outwardly from the tube.

11. The receiver of claim 7, wherein said means comprises a section of the lower end of said tube having a cross-section which is considerably larger than an upper portion of the tube so that liquid refrigerant enters the tube at a velocity slower than through said upper portion so as to prevent or minimize the formation of a vortex in the liquid adjacent the inlet to the tube.

12. A method to minimize the amount of refrigerant stored in a receiver of a refrigeration system, said method comprising the steps of:

providing a receiver container with a liquid refrigerant outlet tube extending into the container and having an open lower end adjacent a low point in the container to enable liquid refrigerant to be drawn out of the container; and preventing vapor from entering the tube by preventing a vortex from being formed in the liquid refrigerant adjacent the lower end of the tube.

13. The method of claim 12, wherein said preventing step includes positioning an element adjacent the lower end of the tube that blocks liquid refrigerant from flowing into the tube in a manner that would create a vortex that would allow vapor to enter the outlet tube.

14. The method of claim 13, wherein said preventing step includes positioning a second element above said blocking element that deflects liquid refrigerant falling from an inlet to the container, in a manner that would cause refrigerant vapor to be drawn into the outlet tube.

15. The method of claim 12, wherein said preventing step includes providing a lower section of said tube with an internal cross-section considerably larger than an upper portion of said outlet tube to reduce the velocity of refrigerant entering the outlet tube.

16. The method of claim 12 including the step of directing incoming refrigerant flow to the receiver against an interior wall of the receiver to prevent refrigerant vapor in the liquid refrigerant at the bottom of the receiver.

* * * * *